United States Patent [19]

Mattioli et al.

[11] 4,158,562

[45] Jun. 19, 1979

[54] BLAST FURNACE TESTING AND CONTROL METHODS

[75] Inventors: Terrence W. Mattioli, King of Prussia; Glenn D. Williams, Berwyn, both of Pa.

[73] Assignee: Betz Laboratories, Inc., Trevose, Pa.

[21] Appl. No.: 900,221

[22] Filed: Apr. 26, 1978

[51] Int. Cl.[2] ..... C21B 7/00

[52] U.S. Cl. ..... 75/41; 75/25; 266/44; 266/80; 266/159

[58] Field of Search ..... 75/41, 42, 25; 266/44, 266/80, 159

[56] References Cited

U.S. PATENT DOCUMENTS

| | | | |
|---|---|---|---|
| 3,719,811 | 3/1973 | Munson | 75/41 X |
| 3,726,065 | 4/1973 | Hausberg et al. | 266/80 X |
| 3,767,379 | 10/1973 | Marion | 75/42 |

*Primary Examiner*—M. J. Andrews

*Attorney, Agent, or Firm*—Alexander D. Ricci; Steven H. Markowitz

[57] ABSTRACT

A method for evaluating and/or controlling a blast furnace operation is disclosed wherein the carbon content of off-gases is measured at a test point located downstream of the wet scrubber.

31 Claims, 2 Drawing Figures

BLAST FURNACE TESTING AND CONTROL METHODS

The present invention relates to methods for evaluating and controlling the operation of a blast furnace. Since blast furnaces are used primarily for producing iron, the present invention will be described as it applies to that metal.

Most commercial metals are produced by reducing their ores to the metallic state and removing impurities therefrom as slag.

For example, iron is produced from its primary ores magnetite ($Fe_3O_4$) and hematite ($Fe_2O_3$) by reduction with carbon and carbon monoxide in a process known as "reduction smelting." Reduction smelting is carried out in a blast furnace which generally takes the form of a vertically elongated stack having divergent-convergent walls from top to bottom.

In the basic iron smelting process, alternate layers of iron-bearing material (ore, pellets, sinter, etc.), limestone and carbon-containing stock (which is typically coke) are formed within the stack by alternately feeding each into the top thereof. The resulting charge formed within the furnace is a porous bed which is referred to as the "burden." Located along the outside wall of the furnace and near the bottom end thereof is an annular air-supply manifold connected to a series of air injection nozzles known as "tuyeres." The tuyeres are circumferentially spaced about the furnace and protrude thereinto at a level which is below the burden. They serve to feed preheated air known as "hot blast" air into the furnace. The area on the inside of the furnace just in front of each tuyere forms a combustion zone known as a "raceway." In the raceway, oxygen from the hot blast air reacts with carbon from the coke to generate heat and form the reducing agent carbon monoxide according to the following basic reactions:

$$C+O_2 \rightarrow CO_2+\text{heat}$$

$$CO_2+C \rightarrow 2CO$$

The iron ore is accordingly reduced to metallic iron according to the basic reaction:

$$3CO+Fe_2O_3 \rightarrow 2Fe+3CO_2$$

Also, the limestone reacts with such impurities in the ore as alumina and silica to form low-melting slag according to the reaction:

$$n\,CaO+mSiO_2+pAl_2O_3 \rightarrow nCaO.mSiO_2.pAl_2O_3$$

The molten slag and molten metallic iron flow downwardly through the porous burden and form separate layers at the bottom of the furnace from where they are removed through separate tap holes. As the coke is converted into carbonaceous gases, these gases pass upwardly through the porous burden and out of the furnace stack as off-gases. Of course the off-gases will contain dust particles and unreacted particulate carbon. To remove at least a portion of the dust particles from the off-gases, a dry particle separator is typically located downstream of the furnace. This separator typically takes the form of a simple mechanical device in which the dust-laden off-gases are forced to change direction abruptly, thus forcing the larger particles therefrom. Since the off-gases exiting the dry separator still contain particulate matter, they are forced to pass through another separator which is typically a wet scrubber. In the wet scrubber the dust-laden off-gases are passed through a liquid spray to force smaller particles therefrom. While the foregoing description covers but a small part of a complete blast furnace system, it is considered to be quite sufficient for a proper understanding of the present invention.

The state of the art of blast furnace operation has developed to the point where it is generally known that the furnace efficiency can be increased by raising the hot blast temperature (the temperature of the preheated air). However, to increase the hot blast temperature (HBT), it is also known that coolants must be added to the hot blast for controlling what is known as the theoretical flame temperature in the combustion zone at the tuyeres. The most widely used coolants have been natural gas, coke oven gas, fuel oil, tar, pulverized coal and moisture; and they are generally applied by direct injection into the tuyeres.

The theoretical flame temperature, which is also known as the adiabatic flame temperature (AFT), is basically a theoretical number which has been developed over the years as a useful tool in blast furnace operations. It is known that the AFT must be maintained within certain limits if a given blast furnace is to be operated relatively efficiently. The AFT of a given furnace has been defined algebraically as follows:

$$AFT=2642+(0.73\times HBT)-(21.5\times B.M.)+(93\times O_2\text{ Enrich})-(92.5\times\text{inj. oil})-(64\times\text{inj. tar})-(180\times\text{inj. Nat. gas})-(82\times\text{inj. coal})-(137\times\text{inj. C.O. gas})$$

where

HBT = hot blast temperature in degrees farenheit.

B.M. = moisture in hot blast in grains per standard cubic foot, $O_2$ Enrich = % $O_2$ in hot blast − % $O_2$ in air, inj. oil = oil injected into hot blast in pounds per thousand standard cubic feet (p/mscf), inj. tar = tar injected into hot blast in p/mscf, inj. Nat. gas = natural gas injected into hot blast in p/mscf, inj. coal = pulverized coal injected into hot blast in p/mscf, and inj. C.O. gas = coke oven gas injected into hot blast in p/mscf.

As already mentioned, if the hot blast temperature is to be raised so as to increase the efficiency of the blast furnace, coolants must be added to properly control the AFT. It has also already been mentioned that those coolants which are commonly used are natural gas, coke oven gas, fuel oil, tar, pulverized coal and moisture. These coolants are preferred because for the most part they can be used as substitute sources of carbon for use in the blast furnace. The two best and most widely used coolants are fuel oil and tar.

While coolant (fuel) injection into the tuyeres does help control the adiabatic flame temperature and provides a substitute source of carbon, there are definite limitations with respect to the amount which can be used. In the first place, the blast furnace burden has a minimum permeability below which the blast furnace will not operate properly, and this critical permeability is directly proportional to the amount of coke in the furnace. Thus, there is a definite upper limit on the amount of fuel injection which can be used. Also, the combustion time in the raceway is seen to be a limiting factor. As already noted, one of the basic reactions occurring in the blast furnace is the combustion of carbon to form the reducing agent carbon monoxide, and this reaction primarily takes place in the raceway. If more fuel is injected than can be handled by the available oxygen at the raceway, unreacted carbon will pass through the system which is considered to be harmful to the environment. This particular problem can be resolved to at least some extent by adding combustion catalyst to the fuel so as to increase the rate of the combustion reaction. Finally, the amount of fuel injection is limited by the blast furnace operation itself in that too much fuel simply disrupts the operation.

As can be seen from the foregoing, the efficient operation of a blast furnace depends on many variables. It was with this in mind that the present inventors searched for methods to evaluate the effects of these variables on a blast furnace operation. During their search, the idea was conceived of trying to somehow relate the operation to the particulate carbon content of the offgases. However, preliminary test methods either failed or were considered unsuitable. One such test method utilized well known optical transmittance instruments which relate gas opacity to light transmittance variations. While such instruments were used in various points of a blast furnace system, the test results were unreproducible or indiscernible. Various water sampling methods at the wet scrubber of the system were also tried. These methods were visual inspection of scrubber water, determination of the total carbon content in a scrubber water sample, and microscopic inspection of carbon particles in a scrubber water sample. Not only were these tests very time consuming, but the results were considered to be inconclusive.

It was during their continued pursuit of useful test methods that the present inventors discovered that by properly locating the test (sampling) point in the blast furnace system, the operation could be quickly and reliably evaluated. Stated differently, the present inventors discovered that the test point in the system is cricital. More specifically, the present inventors discovered that if the particulate carbon content of blast furnace off-gases is evaluated at a test point located downstream of the wet scrubber, in the direction of flow of off-gases, the test results can be closely and quickly related to changes in blast furnace conditions.

As already noted, the majority of blast furnace systems include a dry particle separator, commonly referred to as a dust collector, between the blast furnace and the wet scrubber. This collector removes larger particles from the off-gases by forcing an abrupt change in their flow direction. Accordingly, methods according to the present invention are considered to be particularly useful in blast furnace systems having dry particle removing means between the blast furnace and the wet scrubber.

The wet scrubber of a blast furnace system typically includes a washer section wherein the off-gases are sprayed with a wet scrubbing medium to remove smaller-size particulate matter therefrom and a cooling tower section wherein the hot off-gases from the washer section are cooled. Accordingly, the term wet scrubber is intended to include those systems which include a cooling tower section. A particularly preferred test point is the off-gases exit conduit from the wet scrubber, which in a system having a cooling tower section would be the off-gases exit conduit from the tower.

The particular method for evaluating the carbon content of the off-gases is not considered to be critical, and both qualitative and quantitative methods are seen to be suitable. However, according to a most preferred embodiment according to the present invention, a fume-carbon sampling pump "smoke gun," sold under the trademark TRUE-SPOT Smoke Tester by Bacharach Instrument Company is used. Basically, the smoke gun sucks a representative sampling of off-gases from a system flow conduit and forces the sampling through a filter medium. The discoloration of the filter medium due to the carbon particles collected is then compared to a prepared color chart, and the carbon content of the gas stream is accordingly qualitatively determined.

Those variables which have been determined to affect the carbon content of the off-gases are:

1. the carbon feed rate to the blast furnace, whether it results from coke, fuel oil injection, tar injection, coke oven gas injection, or natural gas injection;
2. the distribution of carbon injection amongst the tuyeres;
3. the feed rate of hot blast for the furnace;
4. the feed rate of combustion catalyst;
5. the hot blast temperature;
6. the moisture content of the hot blast; and
7. the oxygen content of the hot blast which is varied by oxygen injection.

Accordingly, it should now readily occur to the artisan that the effect of any of these variables on the carbon content of the off-gases can be evaluated according to an inventive method. It should also now occur that an inventive method could be used to control the operation of a furnace system by comparing the carbon content of the off-gas to a set point, and if the comparison exceeds a predetermined maximum allowable deviation, adjusting one of the listed variables which affect the off-gas carbon content.

The already discussed and other objects, features and advantages of the present invention will become more apparent from the following description when taken in connection with the accompanying drawing which shows, for purposes of illustration, an embodiment in accordance with the present invention and wherein.

Figures 1, 2:
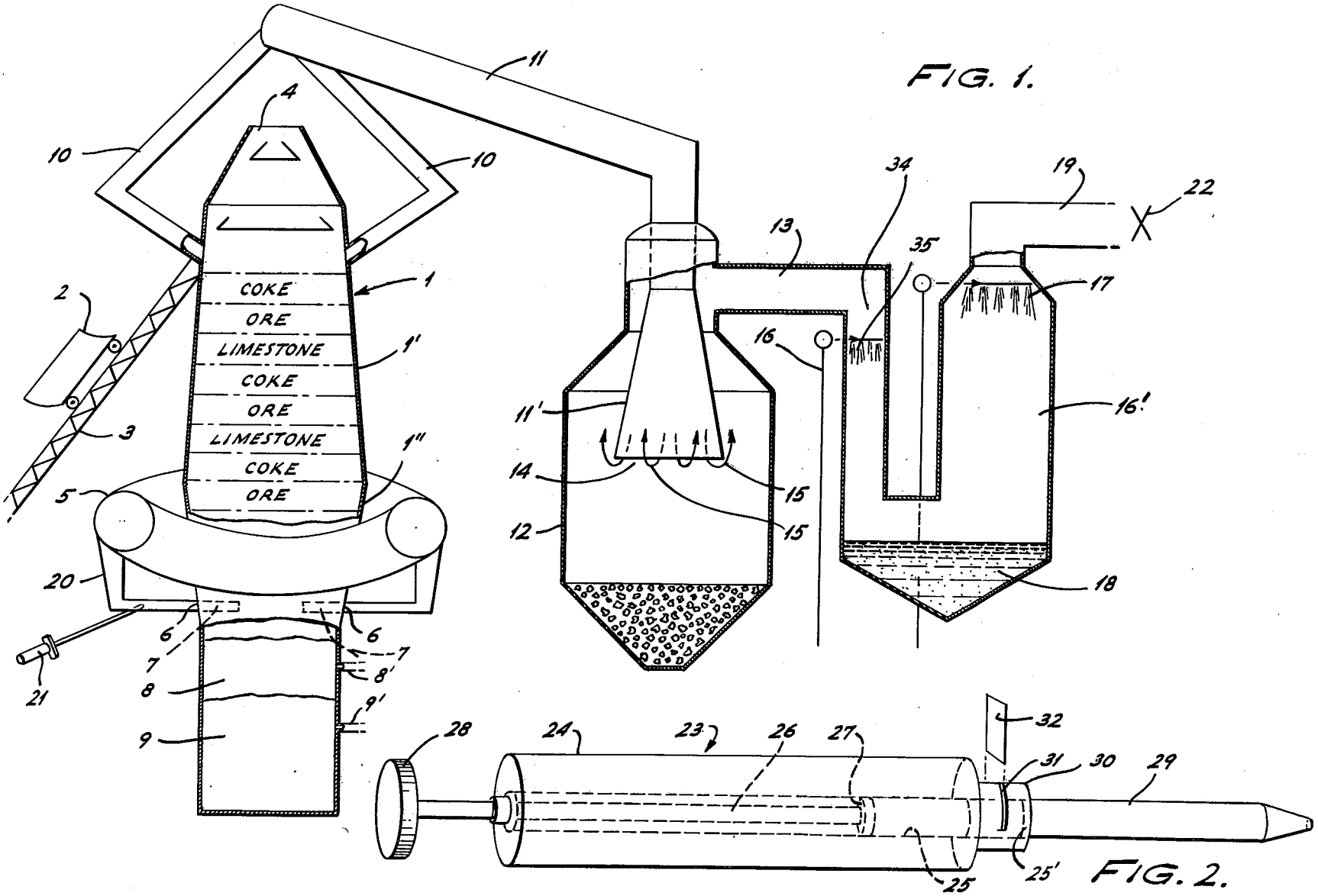
FIG. 1 is a partial schematic view of a blast furnace system.
FIG. 2 is a schematic view of a smoke gun which can be used in practicing a method according to the present invention.

Referring now to the drawing, and more particularly to FIG. 1, reference numeral 1 indicates a blast furnace having divergent-convergent walls 1' and 1'', respectively. Schematically shown within blast furnace 1 are alternate layers of coke, ore and limestone. These layers are formed by alternately feeding each through a receiving hopper 4 at the top of the furnace using a skip car 2 which carries each material along track 3 from a loading area to the receiving hopper. Element 5 is a manifold, known as a bustle pipe, for delivering hot blast air to tuyeres 6. The combustion raceways are indicated at 7. As already noted, in the combustion raceways, oxygen from the hot blast reacts with carbon from the coke to generate heat and form the reducing agent carbon monoxide. Accordingly, the carbon monoxide reduces the iron ore to its metallic state and the iron melts. As the iron melts it flows downwardly through the burden to the bottom of the blast furnace. Also as already noted, the limestone in the furnace will react with impurities in the ore to form molten slag which also flows downwardly through the burden to the bottom of the furnace. Owing to their differences in density and mutual immiscibility, the molten slag and molten iron form separate layers 8 and 9 at the furnace bottom where the upper slag layer 8 is removed through tap 8' and the lower iron layer is removed through tap 9'. The blast furnace off-gases which are formed flow upwardly through the furnace and leave the same through uptakes 10. These off-gases, which contain particulate carbon, then typically flow through downcomer 11 and into dry particle removing means 12 which takes the form of a typical dust separator. The gases enter separator 12 through downwardly directed inlet conduit 11' and exit therefrom through outlet conduit 13. By locating the opening 14 of the inlet conduit 11' below outlet conduit 13, the off-gases are forced to make an abrupt change in flow direction, as indicated by arrows 15, thus forcing larger particles from the off-gases. As shown in the drawing, the removed particles collect at the bottom of the spearator. The off-gases leaving the separator next flow through conduit 13 into wet scrubber means 34. As is well known in the art, the off-gases, which still contain particles, are forced through a shower 35 of wet scrubber medium, such as water, to further remove particles therefrom. Reference numeral 16 refers to the scrubbing medium supply to the wet scrubber 34. The off-gases from the wet scrubber are typically then directed through schematically illustrated cooling tower section 16' wherein the gases are cooled by a spray of cooling liquid 17, typically water. Particle-containing spray liquids from both the cooling tower and wet scrubber collect in sump 18 and the off-gases leave the cooling tower through exit conduit 19.

With reference again to the blast furnace 1, as already noted the efficiency thereof can be increased by increasing the hot blast temperature; however, coolants must then be added by fuel injection to control the theoretical flame temperature. Basically, the fuel injection is accomplished by simply injecting the selected coolant into blowpipes 20 using an injection nozzle 21 known as a lance.

As already noted, the present inventors have discovered that the particulate carbon-content of the off-gases can be quickly and reliably related to the blast furnace operation if the particulate carbon content of the off-gases is determined at a critical test point in the system. That test point is generally indicated at 22 in FIG. 1 and it is intended to include any location which is downstream of wet scrubber 14. The exit conduit from the wet scrubber is considered to be a particularly suitable test point and as such is the preferred one.

A smoke gun which is particularly well suited for use in practicing a method according to the present invention is illustrated schematically in FIG. 2. The smoke gun, which is generally indicated by reference numeral 23, consists of cylindrical body 24 and bushing 30 through which extends longitudinal opening 25. Slideably received within opening 25 is rod 26 which at one end 27 is dimensioned so as to substantially block opening 25. Handle 28 is provided at the other end of rod 26 for moving the rod back-and-forth within opening 25. The outer end 25' of opening 25 is connected in fluid flow communication with tube means 29. Bushing 30 contains a slot 31 which extends from an outside surface thereof into opening 25. Filter medium 32, shown as a sheet of filter paper, is received within slot 31 so as to at least partially block opening 25.

The smoke gun would be used to evaluate the operation of the illustrated blast furnace as follows. A piece of filter medium is inserted into slot 31 so as to at least partially block opening 25. Tube 29 is then inserted into an off-gases flow conduit downstream of the wet scrubber 14, such as at test point 22. The rod 26 is then pumped a given number of times thus forcing a sampling of off-gases across the filter paper. The filter paper, which has obviously been discolored by the carbon contained in the off-gases, is then removed and its degree of discoloration is compared to either a set standard or to previously tested filter papers. If, for example, the degree of discoloration exceeds a given predetermined set point, adjustments can be made at the blast furnace to bring the degree of discoloration to within acceptable limits. For example, either the rate of fuel injection or the feed rate of combustion catalyst could be increased or decreased as required.

EXAMPLE

The close, sensitive relationship between the carbon-content of the off-gases downstream of the wet scrubber and blast furnace operating conditions is illustrated in this example wherein are reported the results of tests conducted on a blast furnace at a well known mid-western steel company.

The blast furnace is best described as follows:

Rating: 2500–2800 tons per day

Normal blowing rate: 90,000–105,000 CFM (cubic feet per min)

Normal hot blast: 1800° F.

Normal oxygen rate: 2500 CFM

Oil injection lances: 14 of ⅛ inch stainless steel pipe

Gas cleaning system: recirculated water

Number 6 fuel oil was being injected approximately 50 minutes of each hour at a rate of 20 to 28 gallons per minute with an inlet temperature of 210° to 250° F. The blast furnace conforms to the schematically illustrated furnace in FIG. 1 of the drawing.

Using a "True Spot Smoke Tester, Model RCC-B" instrument sold by Bacharach Instrument Company, off-gases samples were taken downstream of the water scrubber (as at point 22 in the drawing) at 10 minute intervals. Filter paper discoloration readings were taken by comparing tested filter paper discoloration with those from a "Bacharach Oil Burner Smoke Scale." The lower the reading number, the better was the performance of the blast furnace. The results of these tests are reported below in Tables 1–3 with the columns labelled "Number" indicating the sequence in which the readings were made, and the "oil off" comment indicating that oil injection was turned off.

TABLE 1

| Number | Reading | Comment |
|---|---|---|
| 1 | 6 | |
| 2 | 6 | |
| 3 | 2 | oil off |
| 4 | 6 | |
| 5 | 6 | |

TABLE 2

| Number | Reading | Comment |
|---|---|---|
| 1 | 9 | |
| 2 | 8 | |
| 3 | 1 | oil off |
| 4 | 7 | |

TABLE 2-continued

| Number | Reading | Comment |
|---|---|---|
| 5 | 7 | |

TABLE 3

| Number | Reading | Comment |
|---|---|---|
| 1 | 6 | |
| 2 | 4 | |
| 3 | 1 | oil off |
| 4 | 8 | |
| 5 | 7 | |

As can be seen from the tables, the carbon-content of the off-gases correlated very closely with the change in conditions at the blast furnace. In comparison, samples were also taken using the smoke gun at a test point between the dry particle separator and the water scrubber and the differences between resulting readings were considered to be indiscernible.

Having thus described our invention, we claim:

1. A method for evaluating the operation of a blast furnace system having wet scrubber means for wet scrubbing particulate matter from blast furnace off-gases, said wet scrubber means being located downstream of blast furnace means in the direction of flow of the off-gases, which method comprises evaluating the carbon content of the off-gases at at least one test point located downstream of the wet scrubber means in the direction of flow of the off-gases.

2. A method according to claim 1, wherein the particulate carbon content of the off-gases is evaluated.

3. A method according to claim 2, wherein dry particle-removing means for the dry removal of particulate matter from the off-gases are located between the blast furnace means and the wet scrubber means.

4. A method according to claim 2, the wet scrubber means being provided with gas outlet means in which outlet means the test point is located.

5. A method according to claim 3, the wet scrubber means being provided with gas outlet means, in which outlet means the test point is located.

6. A method according to claim 3, wherein the carbon content of the off-gases is evaluated qualitatively.

7. A method according to claim 6, wherein the qualitative evaluation comprises exposing particulate carbon filter means to the off-gases.

8. A method according to claim 7, wherein the qualitative evaluation is accomplished using smoke gun means.

9. A method according to claim 3, wherein the blast furnace operation comprises the variable steps of feeding iron ore to be reduced to the blast furnace means and feeding carbon-containing stock and hot blast air to the blast furnace means to produce reducing agents for reducing the iron ore to metallic iron, and wherein at least one of the feed rate of the carbon-containing stock, the feed rate of the hot blast air, and the temperature of the hot blast air is varied while the others are held constant.

10. A method according to claim 8, wherein the blast furnace operation comprises the variable steps of feeding iron ore to be reduced to the blast furnace means and feeding carbon-containing stock and hot blast air thereto to produce reducing agents for reducing the iron ore to metallic iron, and wherein at least one of the feed rate of the carbon-containing stock, the feed rate of the hot blast air, and the temperature of the hot blast air is varied while the others are held constant.

11. A method according to claim 9, wherein the blast furnace operation further comprises the variable steps of feeding combustion catalyst to a portion of the carbon-containing stock and wherein at least one of the feed rate of the carbon-containing stock, the feed rate of the hot blast air, the feed rate of the combustion catalyst and the temperature of the hot blast air is varied while holding the rest constant.

12. A method according to claim 11, wherein the blast furnace operation further comprises at least one of the variable steps of feeding moisture to the hot blast air and injecting oxygen into the hot blast air, and wherein at least one of the feed rate of the carbon-containing stock, the feed rate of the hot blast air the feed rate of the combustion catalyst, the feed rate of the moisture, the rate of oxygen injection and the temperature of the hot blast air is varied while holding the rest constant.

13. A method according to claim 12, wherein the blast furnace system includes a plurality of tuyeres circumferentially spaced about the blast furnace means for feeding the hot blast air into the blast furnace means, wherein a portion of the carbon-containing stock fed to the blast furnace means is fuel-injected into the tuyeres, wherein the distribution of fuel injection amongst the tuyeres is varied, and wherein at least one of the feed rate of the carbon-containing stock, the feed rate of the hot blast air, the feed rate of the combustion catalyst, the feed rate of the moisture, the rate of oxygen injection, the temperature of the hot blast air and the distribution of fuel injection amongst the tuyeres is varied while holding the rest constant.

14. A method according to claim 10, wherein the blast furnace operation further comprises the variable step of feeding combustion catalyst to the carbon-containing stock and wherein at least one of the feed rates of the carbon-containing stock, the hot blast air and the combustion catalyst, and the temperature of the hot blast air is varied while holding the rest constant.

15. A method according to claim 14, wherein the blast furnace operation further comprises at least one of the variable steps of feeding moisture to the hot blast air and injecting oxygen into the hot blast air, and wherein at least one of the feed rate of the carbon-containing stock, the feed rate of the hot blast air, the feed rate of the combustion catalyst, the feed rate of the moisture, the rate of oxygen injection and the temperature of the hot blast air is varied while holding the rest contant.

16. A method according to claim 15, wherein the blast furnace system includes a plurality of tuyeres circumferentially spaced about the blast furnace means for feeding the hot blast air into the blast furnace means, wherein a portion of the carbon-containing stock fed to the blast furnace means is fuel-injected into the tuyeres, wherein the distribution of fuel injection amongst the tuyeres is varied, and wherein at least one of the feed rate of the carbon-containing stock, the feed rate of the hot blast air, the feed rate of the combustion catalyst, the feed rate of the moisture, the rate of oxygen injection, the temperature of the hot blast air and the distribution of fuel injection amongst the tuyeres is varied while holding the rest constant.

17. A method for controlling the operating efficiency of a blast furnace operation wherein iron to be smelted is fed to a blast furnace, wherein carbon-containing stock and hot blast air are also fed thereto to produce reducing agents for reducing the iron to metallic iron, and wherein wet scrubber means are provided downstream of the blast furnace in the direction of flow of blast furnace off-gases for wet scrubbing particulate matter from the off-gases, which method comprises:

(1) determining the carbon content of the off-gases at at least one test point located downstream of the wet scrubber means in the direction of flow of the off-gases, (2) comparing the carbon-content determination from step (1) to a pre-determined set-point, and (3) if the comparison in step (2) exceeds a pre-determined maximum deviation value, adjusting at least one of the feed rates of the carbon-containing stock and the hot blast air and the temperature of the hot blast air.

18. A method according to claim 17, wherein the blast furnace operation further comprises the step of feeding combustion catalyst to the carbon-containing stock and wherein, if the comparision in step (2) exceeds a pre-determined maximum deviation value, at least one of the feed rates of the carbon-containing stock, the hot blast air and the combustion catalyst and the temperature of the hot blast air is adjusted.

19. A method according to claim 17, wherein the blast furnace operation further comprises at least one of the variable steps of feeding moisture to the hot blast air and injecting oxygen into the hot blast air, and wherein if the comparison in step (2) exceeds a predetermined maximum deviation value, at least one of the feed rate of the carbon-containing stock, the feed rate of the hot blast air, the feed rate of the moisture, the temperature of the hot blast air, and the rate of oxygen injection is varied.

20. A method according to claim 18, wherein the blast furnace operation further comprises at least one of the variable steps of feeding moisture to the hot blast air and injecting oxygen into the hot blast air, and wherein if the comparison in step (2) exceeds a predetermined maximum deviation value, at least one of the feed rate of the carbon-containing stock, the feed rate of the hot blast air, the feed rate of the moisture, the temperature of the hot blast air, and the rate of oxygen injection is varied.

21. A method according to claim 17, wherein the particulate carbon-content of the off-gases is determined in step (1).

22. A method according to claim 19, wherein dry particle-removing means for the dry removal of particulate matter from the off-gases are provided between the blast furnace and wet scrubber means in the direction of flow of off-gases.

23. A method according to claim 20, the wet scrubber means being provided with gas outlet means, in which means the test point is located.

24. A method according to claim 22, wherein the carbon content of the off-gases is determined qualitatively in step (1).

25. A method according to claim 23, wherein the qualitative determination comprises exposing particulate carbon filter means to the off-gases.

26. A method according to claim 24, wherein the qualitative determination is accomplished using smoke gun means.

27. A method according to claim 22, wherein the blast furnace operation further comprises the step of feeding combustion catalyst to the carbon-containing stock and wherein, if the comparison in step (2) exceeds a predetermined maximum deviation value, at least one of the feed rates of the carbon-containing stock, the hot blast air and the combustion catalyst and the temperature of the hot blast air is adjusted.

28. A method according to claim 21, wherein the blast furnace operation further comprises at least one of the variable steps of feeding moisture to the hot blast air and injecting oxygen into the hot blast air, and wherein if the comparison in step (2) exceeds a predetermined maximum deviation value, at least one of the feed rate of the carbon-containing stock, the feed rate of the hot blast air, the feed rate of the moisture, the temperature of the hot blast air, and the rate of oxygen injection is varied.

29. A method according to claim 19, wherein the blast furnace has a plurality of tuyeres circumferentially spaced thereabout for feeding the hot blast air into the blast furnace, wherein a portion of the carbon-containing stock fed to the blast furnace is fuel-injected into the tuyeres, wherein the distribution of fuel injection amongst the tuyeres is varied, and wherein if the comparison in step (2) exceeds a predetermined maximum deviation value, at least one of the feed rate of the carbon-containing stock, the feed rate of the hot blast air, the feed rate of the combustion catalyst, the feed rate of the moisture, the rate of oxygen injection, the temperature of the hot blast air and the distribution of fuel injection amongst the tuyeres is adjusted.

30. A method according to claim 20, wherein the blast furnace has a plurality of tuyeres circumferentially spaced thereabout for feeding the hot blast air into the blast furnace, wherein a portion of the carbon-containing stock fed to the blast furnace is fuel-injected into the tuyeres, wherein the distribution of fuel injection amongst the tuyeres is varied, and wherein if the comparison in step (2) exceeds a predetermined maximum deviation value, at least one of the feed rate of the carbon-containing stock, the feed rate of the hot blast air, the feed rate of the combustion catalyst, the feed rate of the moisture, the rate of oxygen injection, the temperature of the hot blast air and the distribution of fuel injection amongst the tuyeres is adjusted.

31. A method according to claim 28, wherein the blast furnace has a plurality of tuyeres circumferentially spaced thereabout for feeding the hot blast air into the blast furnace, wherein a portion of the carbon-containing stock fed to the blast furnace is fuel-injected into the tuyeres, wherein the distribution of fuel injection amongst the tuyeres is varied, and wherein if the comparison in step (2) exceeds a predetermined maximum deviation value, at least one of the feed rate of the carbon-containing stock, the feed rate of the hot blast air, the feed rate of the combustion catalyst, the feed rate of the moisture, the rate of oxygen injection, the temperature of the hot blast air and the distribution of fuel injection amongst the tuyeres is adjusted.

* * * * *